United States Patent [19]

Katoh et al.

[11] Patent Number: 4,689,287

[45] Date of Patent: Aug. 25, 1987

[54] PHOTOGRAPHIC ELEMENT FOR SILVER SALT DIFFUSION TRANSFER PROCESS WITH I ION CAPTURING LAYER

[75] Inventors: Kazunobu Katoh; Hideki Takaki, both of Kanagawa, Japan

[73] Assignee: Fuji Photo Film Co., Ltd., Kanagawa, Japan

[21] Appl. No.: 821,198

[22] Filed: Jan. 22, 1986

[30] Foreign Application Priority Data

Jan. 22, 1985 [JP] Japan ..... 60-009344

[51] Int. Cl.[4] ..... G03C 5/54; G03C 1/485

[52] U.S. Cl. ..... 430/230; 430/227; 430/232; 430/233

[58] Field of Search ..... 430/227, 230, 232, 233, 430/202, 213, 214, 217

[56] References Cited

U.S. PATENT DOCUMENTS

| | | | |
|---|---|---|---|
| 3,174,858 | 3/1965 | Van Hoof et al. | 430/232 |
| 3,958,995 | 5/1976 | Campbell et al. | 430/213 |
| 4,269,924 | 5/1981 | Janssens et al. | 430/214 |
| 4,288,522 | 9/1981 | Carael et al. | 430/233 |
| 4,585,725 | 4/1986 | Sakaguchi | 430/233 |

*Primary Examiner*—Richard L. Schilling

*Attorney, Agent, or Firm*—Sughrue, Mion, Zinn, Macpeak & Seas

[57] ABSTRACT

A silver salt diffusion transfer photographic element which can provide a positive print having good stability is disclosed, comprising (1) a light-sensitive element including a light-sensitive silver halide emulsion layer containing silver iodide, and (2) an image-receiving element including a support and an image-receiving layer containing silver-depositing nuclei, with said image-receiving element having an iodide ion-capturing layer between said support and said image-receiving layer.

50 Claims, No Drawings

PHOTOGRAPHIC ELEMENT FOR SILVER SALT DIFFUSION TRANSFER PROCESS WITH I ION CAPTURING LAYER

FIELD OF THE INVENTION

The present invention relates to a silver salt diffusion transfer photographic element, and more particularly, to an image-receiving element thereof.

BACKGROUND OF THE INVENTION

Diffusion transfer photographic processes, in which silver salts like silver halides are utilized, are well known.

In one type of such process, a light-sensitive element containing an optically exposed silver halide photographic emulsion is brought into face-to-face contact with an image-receiving element containing silver-depositing nuclei, and an alkaline processing solution containing a silver halide solvent is applied in a layer form between these two elements in the presence of a developing agent, whereby development-processing is effected to directly form a positive silver image on the image-receiving element.

More specifically, the unexposed portion of the silver halide emulsion in a light-sensitive element is dissolved in a silver halide solvent in the form of silver ion complex, and then eluted in an alkaline processing solution. Through the elution, the silver ions are transferred into an image-receiving element, and silver-depositing nuclei present in the image-receiving element act on the silver ions to precipitate them as a sliver image, thus forming a direct positive image.

However, the silver images obtained in an image-receiving element by the above-described process have a defect in that they tend to undergo a change in color or discoloration upon storage.

With the intention of obviating such a defect, methods of coating a water-soluble polymer solution containing an alkali neutralizing component on the surface of silver image obtained have been proposed, e.g., in Japanese Patent Publication No. 5392/71, U.S. Pat. No. 3,533,789, and British Pat. No. 1,164,642. However, these methods require a long time for the surface of the polymer coat to dry completely. When the polymer coat is in an undried condition, the surface thereof is so sticky that the prints cannot be placed one upon another. In addition, the formation of fingerprints and the adhesion of dust on the surface of the polymer coat is a frequent problem. Moreover, it is troublesome to require such an additional step of coating such a solution on silver images.

Japanese Patent Publication No. 44418/81 discloses an image-receiving element which comprises a support having provided thereon (I) a layer made up of cellulose ester, polyvinyl ester or polyvinyl acetal, which can be hydrolyzed in water and becomes alkali-penetrable by hydrolysis, and containing a diffusible compound capable of causing a change in a property of silver image, and (II) a regenerated cellulose layer containing silver-deposited nuclei, in the order listed. Therein, organic mercapto compounds are described as the compound which is diffusible and that can cause a change in a property of silver image.

On the other hand, Japanese Patent Publication Nos. 21140/81 and 500431/81 disclose that discoloration of silver image can be prevented by making noble metal compounds act on the silver image.

However, such organic mercapto compounds and noble metal compounds must be incorporated in large amounts in order to achieve the desired protection of silver image, and furthermore, they suffer from the defects that they cause stain, have undesirable influences on the image-forming speed, and so on.

SUMMARY OF THE INVENTION

The present invention relates to a novel means for enhancing the storage stability of a silver image, which is entirely different from conventional means.

Thus, one object of the present invention is to provide a novel diffusion transfer photographic element.

Another object of the present invention is to provide a novel diffusion transfer image-receiving element.

A further object of the present invention is to provide a diffusion transfer image-receiving element which produces no changes in its properties during storage prior to development-processing.

Still another object of the present invention is to provide an image-receiving element for producing a stable silver image using a diffusion transfer process.

A still further object of the present invention is to provide a novel image-stabilizing agent.

The above-described objects have now been attained according to this invention by a silver salt diffusion transfer photographic element, comprising (1) a light-sensitive element including a light-sensitive silver halide emulsion layer containing silver iodide, and (2) an image-receiving element including a support and an image-receiving layer containing silver-depositing nuclei, with said image-receiving element having an iodide ion-capturing layer between said support and said image-receiving layer.

DETAILED DESCRIPTION OF THE INVENTION

Silver salt diffusion transfer photographic element of the present invention are those comprising (1) a light-sensitive element including a light-sensitive silver halide emulsion layer containing silver iodide, and (2) an image-receiving element including a support and an image-receiving layer containing silver-depositing nuclei, with the image-receiving element having an iodide ion-capturing layer between the support and the image-receiving layer.

Suitable examples of layers which can be employed as iodine ion capturing layer in the present invention include those containing cationic polyelectrolytes which have substantially no iodide ions as their counter ions.

The above expression "silver halide emulsion containing silver iodide" refers to a silver halide emulsion containing silver iodide crystals in its halogen composition, for example, silver iodobromide emulsion, silver iodochlorobromide, or the like. A preferable content of silver iodide in such a silver halide emulsion as described above generally ranges from 0.5 to 15 mol%, and particularly preferably ranges from 3 to 10 mol%.

Various factors affecting the stabilization of silver image upon storage have so far been studies, and reported.

In addition, it has now been found that in a highly sensitive silver salt diffusion transfer photographic element which uses a silver iodobromide emulsion in its light-sensitive layer, iodide ions which come to be dissolved in a processing solution as the result of development, to diffuse into an image-receiving layer, and to remain in the neighborhood of silver image, significantly accelerates change in color (discoloration or fading of the image).

As a means of capturing iodide ions to render them harmless, the following techniques can be employed.

(1) Technique Using Anion Exchange Polymer

A layer containing a cationic polyelectrolyte (anion exchanging polymer) having no iodine ions as its counter ions is provided in an image-receiving element.

For example, a cationic polyelectrolyte undergoes anion exchange as follows:

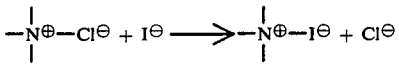

(2) Technique Using Monomer of Quaternary Salt Type

A layer containing a monomer of the quaternary salt type that does not contain iodide ion as a counter ion is provided in an image-receiving element.

(3) Technique Using Compound Capable of Forming Slightly Soluble Salt Together with Iodide Ion A layer containing a silver salt, e.g., a silver halide such as silver chloride, silver bromide or silver iodobromide having a low iodide content, silver nitrate, silver complex salt of polyvinylimidazole, etc., is provided in an image-receiving element.

(4) Technique Using Compound Capable of Forming Stable Complex Salt Together with Iodide Ion A layer containing polyoxyethylene, polyvinyl pyrrolidone, or the like, which is not particularly restricted as to polymerization degree, is provided in an image-receiving element.

Of the foregoing techniques, the use of anion exchange polymers as an iodide ion-capturing agent is particularly advantageous.

Suitable anion exchange polymers which can be used include known, various kinds of polymers of the quaternary ammonium (or phosphonium) salt type. The polymers of the above-described type are widely known as polymeric mordants or antistatic polymers. Specific examples thereof include latexes with water as the disperse phase, which are described in Japanese Patent Application (OPI) No. 166940/84, U.S. Pat. No. 3,958,995, and Japanese Patent Application (OPI) Nos. 142339/80, 126027/79, 155835/79, 30328/78, and 92274/79; polyvinyl pyridinium salts described in U.S. Pat. Nos. 2,548,564, 3,148,061, and 3,756,814; water soluble polymers of the quaternary ammonium salt type described in U.S. Pat. No. 3,709,690; and water insoluble polymers of the quaternary ammonium salt type described in U.S. Pat. No. 3,898,088.

Preferred anion exchange polymers comprise repeating units represented by formula (I)

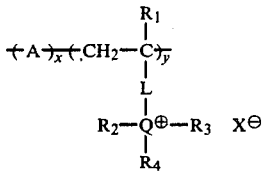

(I)

wherein A represents a repeating unit formed from an ethylenic unsaturated monomer unit; $R_1$ represents a hydrogen atom or a lower alkyl group having from 1 to about 6 carbon atoms; L represents a divalent group having from 1 to about 20 carbon atoms; $R_2$, $R_3$, and $R_4$ (which may be the same or different) each represents an alkyl group having from 1 to about 20 carbon atoms or an aralkyl group having from 7 to about 20 carbon atoms, or two of $R_2$, $R_3$, and $R_4$ combine with each other to form a ring structure together with Q; Q represents N or P; $X^{\ominus}$ represents an anion other than iodide; x is from 0 to about 90 mol%; and y is from about 10 to 100 mol%.

Suitable examples of ethylenic unsaturated monomers that can be used to form the repeating unit represented by A in formula (I) include olefins (such as ethylene, propylene, 1-butene, vinyl chloride, vinylidene chloride, isobutene, vinyl bromide, and the like), dienes (such as butadiene, isoprene, chloroprene, and the like), ethylenic unsaturated esters of fatty acids or aromatic carboxylic acids (such as vinyl acetate, allyl acetate, vinyl propionate, vinyl butyrate, vinyl benzoate, and the like), esters of ethylenic unsaturated acids (such as methylmethacrylate, butylmethacrylate, tert-butylmethacrylate, cyclohexylmethacrylate, benzylmethacrylate, phenylmethacrylate, octylmethacrylate, amylacrylate, 2-ethylhexylacrylate, benzylacrylate, dibutyl maleate, diethyl fumarate, ethyl crotonate, dibutyl methylenemalonate, and the like); styrenes (such as styrene, α-methylstyrene, vinyl toluene, chloromethylstyrene, chlorostyrene, dichlorostyrene, boromostyrene and the like), unsaturated nitriles (such as acrylonitrile, methacrylonitrile, allyl cyanate, crotononitrile, and the like). Of these monomers, styrenes and methacrylates are particularly advantageous from the viewpoint of ease of emulsion polymerization, hydrophobicity, and so on. A may be formed using two or more of the above-described monomers.

As a substituent represented by $R_1$, a hydrogen atom or a methyl group is preferred from the viewpoints of polymerization reactivity and so on.

In the case of divalent groups represented by L, those having the structures

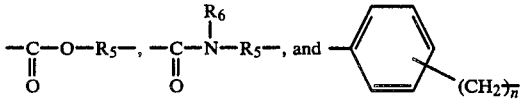

are preferred over others. Of these groups,

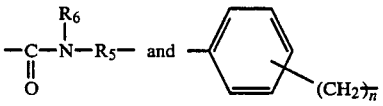

are more desirable from the viewpoints of alkali resistance and so on. In particular,

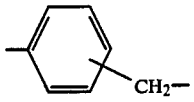

is advantageous from the viewpoints of facility in emulsion polymerization and so on. In the above structural formulae, $R_5$ represents an alkylene group (e.g., methylene, ethylene, trimethylene, tetramethylene, etc.), an arylene group, or an aralkylene group

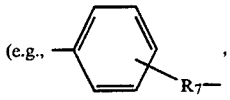

wherein $R_7$ represents an alkylene group containing from 0 to about 6 carbon atoms), $R_6$ represents a hydrogen atom or a substituent as represented by $R_2$, and n is an integer of 1 or 2.

As for the atom represented by Q, nitrogen is preferred to phosphorus from the viewpoint of the avoidance of toxic starting materials.

$X^{\ominus}$ is an anion other than iodide ion, with specific examples including halogen ions (e.g., chloride ion, bromide ion, etc.), alkylsulfate ions (e.g., methylsulfate ion, ethylsulfate ion, etc.), alkyl- or aryl-sulfonate ions (e.g., methanesulfonate ion, ethanesulfonate ion, benzenesulfonate ion, p-toluenesulfonate ion, etc.), nitrate ion, acetate ion, sulfate ion, and so on. Therein, chloride ions, alkyl-sulfate ions, arylsulfonate ions, and nitrate ions are particularly preferred over others.

Alkyl groups and aralkyl groups represented by $R_2$, $R_3$, and $R_4$ include those having certain substituent groups.

More specifically, such alkyl groups include unsubstituted ones such as methyl group, ethyl group, propyl group, isopropyl group, t-butyl group, hexyl group, cyclohexyl group, 2-ethylhexyl group, dodecyl group and so on, and substituted ones such as alkoxyalkyl groups (e.g., methoxymethyl, methoxybutyl, ethoxyethyl, butoxyethyl, vinyloxyethyl, etc.), cyanoalkyl groups (e.g., 2-cyanoethyl, 3-cyanopropyl, etc.), halogenated alkyl groups (e.g., 2-fluoroethyl, 2-chloroethyl, perfluoropropyl, etc.), alkoxycarbonylalkyl groups (e.g., ethoxycarbonylmethyl, etc.), allyl group, 2-butenyl group, propargyl group and so on.

Specific examples of such aralkyl groups include unsubstituted groups such as benzyl group, phenethyl group, diphenylmethyl group, naphthylmethyl group, etc., and substituted groups such as alkylaralkyl groups (e.g., 4-methylbenzyl, 2,5-dimethylbenzyl, 4-isopropylbenzyl, 4-octylbenzyl, etc.), alkoxyaralkyl groups (e.g., 4-methoxybenzyl, 4-pentafluoropropenyloxybenzyl, 4-ethoxybenzyl, etc.), cyanoaralkyl groups (e.g., 4-cyanobenzyl, 4-(4-cyanophenyl)benzyl, etc.), halogenated aralkyl groups (e.g., 4-chlorobenzyl, 3-chlorobenzyl, 4-bromobenzyl, 4-(4-chlorophenyl)benzyl, etc.), and so on.

Of these groups, alkyl groups having from 1 to 12 carbon atoms and aralkyl groups having from 7 to 14 carbon atoms are more desirable.

Suitable examples of ring structures formed by combining Q and two of substituents of $R_2$, $R_3$, and $R_4$ to one another include those represented by the formula

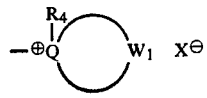

wherein $W_1$ represents atoms forming an aliphatic heterocyclic ring together with Q, with specific examples including

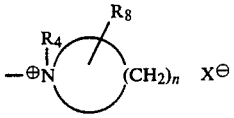

(wherein $R_8$ represents a hydrogen or $R_4$, and n is an integer of from 2 to 12),

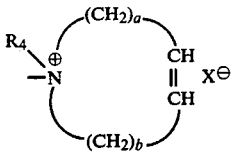

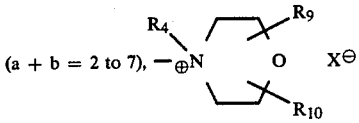

(wherein $R_9$ and $R_{10}$ independently a hydrogen atom or a lower alkyl group containing from 1 to 6 carbon atoms),

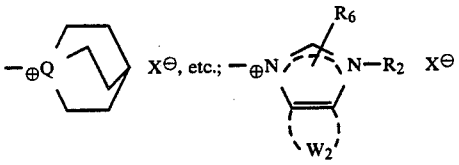

(wherein $W_2$ may be absent, or represent atoms necessary to complete a benzene ring),

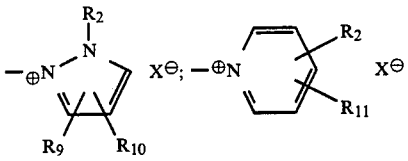

(wherein $R_{11}$ represents a hydrogen atom,

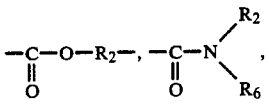

or $R_2$, and when two $R_2$'s are present they may be the same or different); and so on.

Of these ring structures,

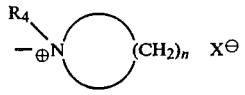

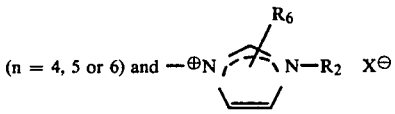

are more advantageous.

In the above ring structures, $R_2$, $R_4$, $R_6$, Q and $X^{\ominus}$ have the same meanings as in formula (I), respectively.

The quaternary salt type monomer component may naturally be a mixture of two or more of the monomers of that type.

x is preferably from 20 to 60 mol%, and y is preferably from 40 to 80 mol%.

A preferred polymer employed in the present invention contains more than 20 mol% of the above-described repeating units of formula (I) therein, and they may be a homopolymer or a copolymer.

Further, in order to prevent the anion exchange polymers illustrated above from moving from the prescribed layer in the image-receiving element to other layers to have photographically undesirable influences therein, it is particularly preferable to use them in the form of aqueous polymer latex, which can be obtained by employing a monomer having at least two (preferably from two to four) ethylenic unsaturated moieties as one of comonomers upon copolymerization to form a cross-linking polymer. In this case, the polymer can contain such copolymerizable monomer in a proportion of 1 to 20 mol%, preferably 3 to 15 mol% based on the total monomer units.

Specific examples of copolymerizable monomers having at least two ethylenic unsaturated moieties include ethylene glycol dimethacrylate, diethylene glycol dimethacrylate, neopentyl glycol dimethacrylate, tetramethylene glycol dimethacrylate, pentaerythritol tetramethacrylate, trimethylolpropane trimethacrylate, ethylene glycol diacrylate, diethylene glycol diacrylate, neopentyl glycol diacrylate, tetramethylene glycol diacrylate, trimethylolpropane triacrylate, allylmethacrylate, allylacrylate, diallylphthalate, methylenebisacrylamide, methylenebismethacrylamide, trivinylcyclohexane, divinylbenzene, N,N-bis(vinylbenzyl)N,N-dimethylammonium chloride, N,N-diethyl-N-(methacryloyloxyethyl)-N-(vinylbenzyl)ammonium chloride, N,N,N',N'-tetraethyl-N',N'-bis(vinylbenzyl)-p-xylylenediammonium dichloride, N,N'-bis(vinylbenzyl)-triethylenediammonium dichloride, N,N,N',N'-tetrabutyl-N,N'-bis(vinylbenzyl)ethylenediammonium dichloride, and so on. Of these monomers, divinylbenzene and trivinylcyclohexane are particularly advantageous from the viewpoints of hydrophobicity, alkali resistance, and so on.

The polymers employed in the present invention can be prepared by a process as described in, e.g., U.S. Pat. No. 4,131,469.

Specific examples of anion exchange polymers which can be preferably employed in the present invention are illustrated below.

Compound I

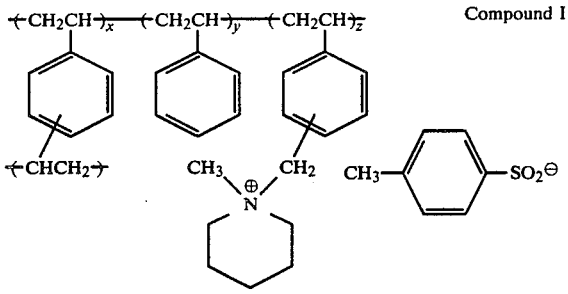

x/y/z = 5/47.5/47.5

Compound II

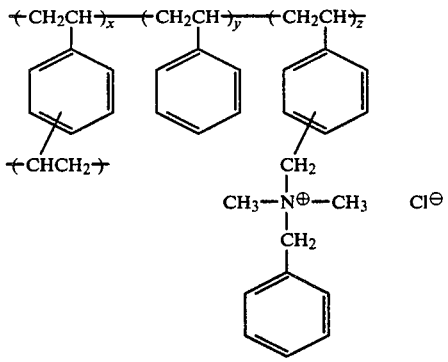

x/y/z = 10/45/45

Compound III

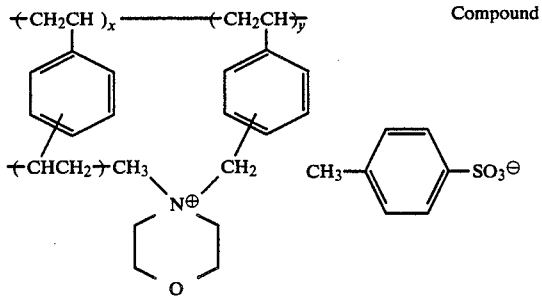

x/y = 5/95

Compound IV

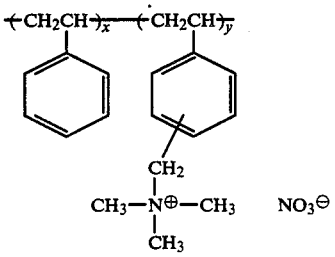

x/y = 50/50

Compound V

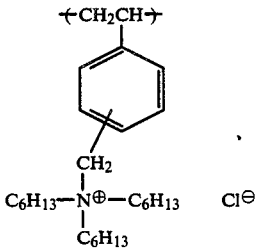

-continued

Compound VI

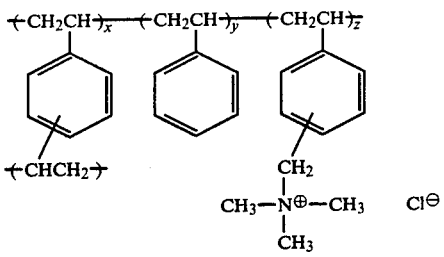

x/y/z = 10/45/45

It is desirable to provide these iodide ion-capturing agents to a particular position of the image-receiving element, preferably between the alkali neutralizing layer and the neutralization timing layer in the case that an alkali neutralizing layer is provided in combination with a neutralization timing layer between the image-receiving layer and the support, or between the support and the alkali neutralizing layer. The coverage of these iodide ion-capturing agents, though the optimum depends on the coverage of iodide ion in the light-sensitive element, generally ranges from 0.3 to 10 g/m$^2$, and preferably from 0.5 to 4.0 g/m$^2$. An iodide ion-capturing layer is prepared by coating these iodide ion-capturing agents, which may be mixed with a proper binder (e.g., cellulose acetate, polyvinyl alcohol, gelatin, polyacrylamide, etc.), if needed, and to which various known additives (e.g., a hardener, a coating aid, a brightening agent, a pigment, etc.) may be added, if desired, using a known coating technique, and then drying the coat formed.

An image-receiving element which can be employed in the present invention comprises, in general, a paper support (e.g., baryta paper, polyethylene-laminated paper, lacquered paper, synthetic paper, etc.) or a film support (e.g., acetyl cellulose film, polyethylene terephthalate film, polystyrene film, etc.) having provided thereon an image-receiving layer which contains silver depositing nuclei selected fom metal sulfides such as nickel sulfide, silver sulfide, palladium sulfide, etc., or noble metal colloids such as colloidal gold, colloidal silver, colloidal palladium, etc., in an alkali penetrable polymer binder such as gelatin, carboxymethyl cellulose, hydroxyethyl cellulose, regenerated cellulose, polyvinyl alcohol, sodium alginate, starch, gum arabic, colloidal silica, or the like.

In a particularly preferred image-receiving layer, regenerated cellulose is employed as binder. Such an image-receiving layer can be prepared in various known manners.

For instance, U.S. Pat. No. 3,179,517 describes the method for preparing an image-receiving layer, which comprises making a regenerated cellulose layer through the hydrolysis of an acetyl cellulose film with an alkali, and soaking the regenerated cellulose layer successively in a gold salt solution and a reductant solution to allow the gold salt to react with the reductant in that layer to produce colloidal gold as silver depositing nuclei. On the other hand, Japanese Patent Publication No. 32754/69 describes the image-receiving element formed using the process which comprises incorporating silver depositing nuclei into an alkali impenetrable polymeric substance using a vacuum deposition technique, dissolving the resulting polymeric substance in a proper solvent, coating the solution on a support, drying the coat, and then, converting the surface part of the polymer coat into an alkali penetrable one by the hydrolysis.

In addition, Japanese Patent Publication No. 43944/71 describes the method for preparing an image-receiving element, which comprises forming silver depositing nuclei in an acetyl cellulose solution, coating the resulting solution on a support, and then hydrolyzing the acetyl cellulose to convert it into regenerated cellulose.

Further, an image-receiving element prepared by hydrolyzing a cellulose ester layer, and incorporating silver depositing nuclei in the hydrolyzed layer simultaneously with or subsequently to the hydrolysis is described in Japanese Patent Publication No. 49411/76.

Furthermore, an image-receiving element prepared by hydrolyzing an acetyl cellulose in its solution with an acid to convert it into one having a low acetyl value and then coating the resulting acetyl cellulose on a support is described in U.S. Pat. No. 4,163,816.

At present a diffusion transfer process is well-known in this art, and detailed description thereof is omitted herein. For details thereof the following books should be referred to: A. Rott & E. Weyde, *Photographic Silver Diffusion Transfer Processes,* Focal Press, London (1972); C. B. Neblette, *Handbook of Photography and Reprography,* 7th Ed., Chapter 12 (entitled "One-Step Photography"), Van Nostrand Reinhold (1977); Haist, *Modern Photographic Processing,* Vol. 2, Chapter 8 (entitled "Diffusion Transfer"); and so on.

According to these diffusion transfer processes, many kinds of photographic materials can be prepared. For instance, it is well known that a light-sensitive material which comprises a support having coated thereon a light-sensitive element containing a silver halide photographic emulsion is brought into face-to-face contact with an image-receiving material which comprises another support having coated thereon an image-receiving element containing silver depositing nuclei and then an alkaline processing composition (a processing element), which may optionally have a high viscosity, containing, for example, a developing agent and a silver halide solvent, is spread in a layer form between the foregoing two elements to form a transferred silver image. In embodying the present invention, the photographic material of this kind can be used to advantage.

Another kind of photographic material is known, in which a light-sensitive element and an image-receiving element are coated in layers on one support, and positive images are observed through negative images by taking advantage of high covering power of the positive images, as described in U.S. Pat. No. 2,861,885. Still another kind of photographic material is known, which has a similar construction to the above-described material, but provides positive images alone by washing off the light-sensitive element after the diffusion transfer processing.

Further, a photographic material of the kind which comprises a support having provided thereon, in sequence, a silver halide emulsion layer, a layer containing a light-reflecting substance like titanium white and an image-receiving layer containing a silver precipitating agent, and provides a positive image by a diffusion transfer processing, is known.

Furthermore, a photographic material having an integral unit structure, which has a light-sensitive layer and an image-receiving layer on the same support and can be used without peeling the image receiving element from the light-sensitive element after diffusion transfer processing, is also known.

On the other hand, an additive color image can be obtained by forming silver transfer image in accordance with the present invention. This image bears a superposed relationship to an additive color screen. In a preferred embodiment, the additive color screen is arranged between a transparent support and the above-described image-receiving layer, and the silver halide emulsion is exposed to light through this screen, thus forming additive process color image.

Details of the photographic materials of these various kinds are described in the foregoing books.

The light-sensitive element which can be employed in the present invention has on a support one or more of a light-sensitive layer containing a silver halide emulsion. Therein, a particularly desirable silver halide is a highly sensitive silver iodobromide (iodine content: 3 to 10 mol%). Such a halide is dispersed in a proper protective colloidal material such as gelatin, agar, albumin, casein, collodion, cellulose type substances like carboxymethyl cellulose, vinyl polymers like polyvinyl alcohol, or linear polyamides like polyhexamethylene adipamide. Emulsions suitable for the foregoing use can be prepared using processes as described, for example, in P. Glafkides, *Chimie et Physique Photographique,* Paul Montel (1967), especially Chapters XVII to XXXIII; G. F. Duffin, *Photographic Emulsion Chemistry,* The Focal Press (1966), especially Chapter IV; V. L. Zelikman et al, *Making and Coating Photographic Emulsion,* The Focal Press (1964), especially Chapters I to IV and V to VII; and so on.

These silver halide emulsions can be subjected to chemical sensitization, spectral sensitization, and supersensitization, if desired. In addition, generally known additives, such as an antifoggant, a hardener, a development accelerator, a surface active agent, an antistatic agent, and so on, can be incorporated in these emulsions.

For the purpose of protecting the light-sensitive layer from physical damages, a protective layer may be provided. Further, it is useful to add matting agent particles to the protective layer from the standpoint of making an improvement in surface slippability and preventing adhesion.

Various kinds of processing compositions can be employed as the processing element in the present invention. Preferred processing compositions comprise a developing agent, a silver halide solvent and an alkali agent, but a developing agent and/or a silver halide solvent can be incorporated in a light-sensitive element and/or an image-receiving element, if desired.

Suitable silver halide developing agents include benzene derivatives containing at least two hydroxyl groups or a hydroxy group and an amino group at the ortho- or para-position, such as hydroquinone, amidol, Metol, glycine, p-aminophenol and pyrogallol; and hydroxylamines, particularly primary and secondary aliphatic and aromatic N-substituted or $\beta$-hydroxylamines, which are soluble in aqueous alkalis, such as hydroxylamine, N-methylhydroxylamine, N-ethylhydroxylamine, those described in Edwin H. Land et al, U.S. Pat. No. 2,857,276, issued Oct. 21, 1958, and N-alkoxyalkyl substituted hydroxylamines as described in Milton Green et al, U.S. Pat. No. 3,293,034, issued Dec. 20, 1966.

Also, hydroxylamine derivatives having tetrahydrofurfuryl group, which are described in Japanese Patent Application (OPI) No. 88521/74, can be employed.

In addition, amino reductions described in German Patent Application (OLS) Nos. 2,009,054, 2,009,055, and 2,009,078, and heterocyclic amino reductions described in U.S. Pat. No. 4,128,425 can be employed.

Further, tetraalkylreductic acids described in U.S. Pat. No. 3,615,440 can be employed.

The above-described developing agents can also be used in combination with an auxiliary developer such as phenidone compounds, p-aminophenol compounds, or ascorbic acid.

Suitable silver halide solvents include conventionally used fixing agents such as sodium thiosulfate, sodium thiocyanate, ammonium thiosulfate and those described in U.S. Pat. No. 2,543,181; and combinations of cyclic imides with nitrogen bases, such as combinations of barbiturate or uracil with ammonia or amines, and combinations described in Edwin H. Land, U.S. Pat. No. 2,857,274, issued Oct. 21, 1958.

In addition, 1,1-bissulfonylalkanes and their derivatives are known, and can be employed as the silver halide solvent of the present invention.

The processing composition contains alkalis, preferably hydroxides of alkali metals, such as sodium hydroxide or potassium hydroxide. When it is applied by spreading in a layer form between two superposed elements, the light-sensitive element and the image-receiving element, the processing composition contains preferably a polymer film forming agent, a thickening agent, or a viscosity increasing agent. Hydroxyethyl celluclose and sodium carboxymethyl cellulose are particularly useful for the above-described uses, and they can be contained in a processing composition in an effective concentration as to impart a proper viscosity on the known principle of the diffusion transfer photographic process. The processing composition may additionally contain other auxiliary agents known in the silver salt diffusion transfer process, such as an antifoggant, a toning agent, a stabilizing agent, and so on.

The image-receiving element to be employed in the present invention comprises, as described above, a support having thereon an image-receiving layer containing silver depositing nuclei in a hydrophilic polymer binder.

Of a large number of known hydrophilic polymers, regenerated cellulose, as described above, are particularly desirable as the hydrophilic polymer binder. Such an image-receiving element can be made using the following methods. For instance, one method involves incorporating a silver precipitating agent into a cellulose ester, e.g., cellulose diacetate, by means of a vacuum deposition technique, coating the resulting cellulose ester on a support, and hydrolyzing the cellulose ester by alkali; another method involves reacting, e.g., silver nitrate with sodium sulfite in a cellulose ester solution to form silver depositing nuclei therein, coating the resulting solution on a support, and hydrolyzing the cellulose ester by alkali; a further method involves hydrolyzing, in the presence of an alkali, a cellulose ester layer previously coated on a support and at the same time, burying silver depositing nuclei in the hydrolyzed layer; and still another method involves hydrolyzing a cellulose ester layer by alkali to convert the cellulose ester into the regenerated cellulose, and reacting, e.g., chloroauric acid with a reducing agent in the hydrolyzed layer to produce silver depositing nuclei.

As the underlayer of the hydrolyzed cellulose ester layer containing silver depositing nuclei, the layer of the unhydrolyzed cellulose ester or the partially hydrolyzed cellulose ester can be kept back, or a polymer layer, e.g., a polyvinyl butyral layer can be provided, if desired. These polymer layers are known to serve as a waterproofing layer.

Further, another hydrophilic polymer layer may be provided between the silver depositing nuclei-containing hydrolyzed cellulose ester layer and the underlayer made up of the cellulose ester or the partially hydrolyzed cellulose ester or a waterproofing layer made up of, e.g., polyvinyl butyral, if needed. Suitable examples of polymers which can be used for this hydrophilic polymer layer include gelatin, gelatin derivatives (e.g., phthaloylated gelatin, etc.), saccharides (e.g., starch, galactomannan, gum arabic, hydroxyethyl cellulose, methyl cellulose, carboxymethyl cellulose, pullulan, hydroxypropyl cellulose, etc.), hydrophilic synthetic polymers (e.g., polyacrylamide, polymethylacrylamide, poly-N-vinylpyrrolidone, 2-hydroxyethylmethacrylate, etc.), and so on.

In addition, an alkali neutralizing layer may be provided, if needed. In forming this alkali neutralizing layer, polymer acids described, e.g., in U.S. Pat. Nos. 3,594,165 and 3,689,262 are used. If an alkali neutralizing layer is provided, it is desired that a neutralization timing layer should be provided between the alkali neutralizing layer and the image-receiving layer.

Further, it is effective for enhancing facility in peeling the processing composition that a layer of a hydrophilic polymer, such as carboxymethyl cellulose, gelatin, gum arabic, dimethylhydantoin-formaldehyde condensate, acetylphthaloylhydrogencellulose, etc., is coated on the image-receiving layer.

In addition, a brightening agent can be added for the purpose of heightening a degree of whiteness, and the addition of a plasticizer is effective for softening the coated polymer layer.

Furthermore, organic mercapto compounds as described in Japanese Patent Publication No. 44418/81, Japanese Patent Application (OPI) No. 120634/74 and Japanese Patent Publication No. 21140/81 may be incorporated as image-stabilizing agents. Also, noble metal compounds as described in Japanese Patent Publication Nos. 500431/81 and 25827/82, and U.S. Pat. No. 4,463,082 can be incorporated as image stabilizing agents.

Examples of silver-depositing nuclei include heavy metals, such as iron, lead, zinc, nickel, cadmium, tin, chromium, copper, cobalt, etc., and, more preferably, noble metals such as gold, silver, platinum, and palladium. Other useful silver-depositing nuclei are sulfides or selenides of heavy metals, particularly sulfides of mercury, copper, aluminum, zinc, cadmium, cobalt, nickel, silver, palladium, lead, antimony, bismuth, cerium and manganese; or selenides of lead, zinc, antiomony and nickel. Functions of materials like silver depositing nuclei in the silver transfer process are described, e.g., in Edwin H. Land et al, U.S. Pat. No. 2,774,667, issued Dec. 18, 1956.

As in known arts, silver depositing nuclei are present in a very small amount, for example, ranging from about $1\times10^{-5}$ to about $2.5\times10^{-4}$ mol/m$^2$. It is generally desirable to use silver-depositing nuclei at the lowest possible level. This is because silver-depositing nuclei present in a concentration higher than the foregoing range occasionally cause deposition of excess silver or generate undesirable background density in highlight areas. A mixture of silver-depositing agents may be employed. Thus, the image-receiving layer can be said to be practically colorless and practically transparent with regard to the presence of silver-depositing nuclei.

Since it has been thought that a change in color of images or discoloration of images can be prevented by stabilizer's action upon image silver, capabilities of forming slightly soluble silver salts or adsorbing firmly on silver have been required of conventional image-stabilizing agents. From these conventional arts, it is entirely unforeseen that cationic polyelectrolytes of the kind which contain no iodine ions as their counter ions have an excellent effect upon stabilization of images, as in the present invention.

The present invention will now be illustrated in more detail by reference to the following examples and comparative examples.

EXAMPLE 1

On a transparent polyethylene terephthalate film support, were coated the layers described below in this order to prepare an image-receiving sheet.

(1) Neutralizing layer containing 6 g/m$^2$ of cellulose acetate (acetylation degree: 53%), 4 g/m$^2$ of methyl vinyl ether-maleic anhydride copolymer, 0.04 g/m$^2$ of Uvitex OB (trademark, product of Ciba Geigy AG), and 0.05 g/m$^2$ of titanium dioxide.

(2) Iodide ion-capturing layer formed by coating a composition prepared by mixing Compound I with an equal amount of gelatin, and then adding formaldehyde thereto in a proportion of 0.5 wt% with respect to the gelatin. Sample numbers and coverages of Compound I in the corresponding samples are set forth in Table 1.

(3) Neutralization timing layer containing 5.0 g/m$^2$ of cellulose acetate (acetylation degree: 55%), and 0.06 g/m$^2$ of 1-(4-hexylcarbamoylphenyl)-2,3-dihydroimidazole-2-thione.

(4) Interlayer containing 1.0 g/m$^2$ of polyacrylamide and 0.03 g/m$^2$ of formaldehyde.

(5) Image-receiving layer containing 2.0 g/m$^2$ of regenerated cellulose, $1.5\times10^{-3}$ g/m$^2$ of palladium sulfide, and $2.5\times10^{-3}$ g/m$^2$ of 2-mercaptobenzimidazole.

(6) Peeling-off layer containing 0.03 g/m$^2$ of butylmethacrylate-acrylic acid copolymer (molar ratio: 15/85).

On the other hand, a light-sensitive sheet was prepared by coating the layers described below in the order listed on a black polyester film support.

(1) Layer containing silver iodobromide emulsion (containing 6.5 mol% of silver iodide, 0.59 g/m$^2$ of silver and 3.5 g/m$^2$ of gelatin, and having a mean grain size (diameter) of 1.0 $\mu$m).

(2) Protective layer containing 0.7 g/m$^2$ of gelatin and 0.1 g/m$^2$ of polymethylmethacrylate.

Further, a processing solution having the following composition was prepared.

| Composition of Processing Solution | |
|---|---|
| Potassium hydroxide (40% aqueous solution) | 323 ml |
| Titanium dioxide | 3 g |
| Hydroxyethyl cellulose | 79 g |
| Zinc oxide | 9.75 g |
| N,N—Bis-methoxyethylhydroxylamine | 75 g |
| Triethanolamine solution (mixing ratio of triethanolamine to water: 4.5/6.2 by weight) | 17.14 g |
| Tetrahydropyrimidinethione | 0.4 g |

-continued

| Composition of Processing Solution | |
|---|---|
| 2,4-Dimercaptopyrimidine | 0.35 g |
| Uracil | 80 g |
| Water | 1193 g |

COMPARATIVE EXAMPLE 1

Instead of the iodide ion-capturing layer provided in Example 1, the layer in which gelatin was mixed with an equal amount of cationic polymer having iodine ions as their counter ions and represented by the following structural formula (Comparative Compound A) was provided. The coverage of Comparative Compound A is shown in Table 1.

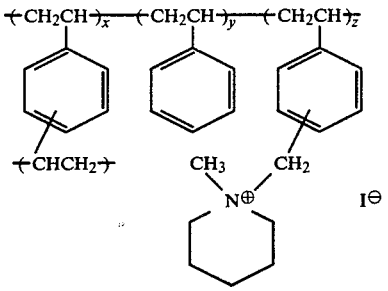

x/y/z = 5/47.5/47.5

COMPARATIVE EXAMPLE 2

A sample was prepared in the same manner as in Example 1, except that the iodide ion-capturing layer was not provided.

TABLE 1

| | Samples | | |
|---|---|---|---|
| | Sample No. | Iodide Ion-Capturing Agent | Coverage |
| Example 1 | I-1 | Compound I | 0.5 g/m$^2$ |
| Example 1 | I-2 | Compound I | 1.0 g/m$^2$ |
| Example 1 | I-3 | Compound I | 2.0 g/m$^2$ |
| Example 1 | I-4 | Compound I | 4.0 g/m$^2$ |
| Comparative Example 1 | A-1 | Comparative Compound A | 1.0 g/m$^2$ |
| Comparative Example 1 | A-2 | Comparative Compound A | 4.5 g/m$^2$ |
| Comparative Example 2 | B | Absent | —(blank) |

The light-sensitive sheet was exposed wedgewise by means of a sensitometer equipped with a light source having a color temperature of 5,400° K. This exposed light-sensitive sheet was superimposed upon the foregoing image-receiving element in a face-to-face relationship, and then the processing solution described above was spread between them in a thickness of 0.035 mm, whereby diffusion transfer development was achieved. Positive prints were prepared by peeling three parts of each image-receiving sheet at different times, that is, after 30 seconds, 2 minutes, and 10 minutes from the beginning of development, respectively.

The thus-obtained positive prints were subjected to a forced deterioration test by allowing them to stand for 7 days under the condition of 60° C. and 70% RH. The extent of deterioration was evaluated using a decrement of optical density against the initial optical density of 0.5 (ΔD). The smaller ΔD is, the less the image deteriorated; that is, low ΔD indicates the more stable image. The results obtained are shown in Table 2.

TABLE 2

| | | Extent of Image Deterioration (ΔD) | | |
|---|---|---|---|---|
| | Sample No. | Peeling off After 30 sec. | Peeling off After 2 min. | Peeling off After 10 min. |
| Example 1 | I-1 | 0.04 | 0.05 | 0.08 |
| Example 1 | I-2 | 0.02 | 0.03 | 0.05 |
| Example 1 | I-3 | 0.01 | 0.00 | 0.01 |
| Example 1 | I-4 | 0.01 | 0.00 | 0.01 |
| Comparative Example | A-1 | 0.04 | 0.09 | 0.20 |
| Comparative Example | A-2 | 0.09 | 0.15 | 0.25 |
| Comparative Example | B | 0.05 | 0.07 | 0.15 |

As can be seen from the results in Table 2, high fastness is attained in accordance with the present invention.

The use of the cationic polymer containing iodide ions as counter ions in Comparative Example, on the contrary, intensified deterioration of images. This fact shows the effective capture of iodide ions by the iodide ion-capturing layer of the present invention.

In addition, other experiments tending to show the adverse influence of iodide ion upon image deterioration were carried out. Namely, the positive print obtained from Sample B was washed with water to remove iodine ions remaining therein. Thus the resulting print caused no deterioration at all by the above-described forced deterioration test, and acquired very high stability. In contrast to this experiment, water solutions containing various kinds of salts, respectively, were coated on different areas of the positive print which had been washed similarly to the above. Deterioration of the image was significantly accelerated by application of potassium iodide thereto, whereas potassium chloride, potassium nitrate, sodium sulfate, sodium p-toluenesulfonate, etc., did not promote the deterioration at all.

EXAMPLE 2

The same experiments were carried out using Compounds II, III and IV, respectively, in place of Compound I in Example 1. In each case, high image stability was achieved similarly to Example 1.

EXAMPLE 3

An iodide ion-capturing layer having the following composition was provided in place of the iodide ion-capturing layer of Example 1.

Sample 3-1: An acetone solution of cellulose acetate (acetylation degree: 50.1%) to which the latex of Compound I was added previously was coated to form an iodide ion-capturing layer.

Sample 3-2: A water solution of polyvinyl alcohol to which the latex of Compound III was added previously was coated to form an iodide ion-capturing layer.

Positive prints obtained by the use of these samples demonstrated high image stability similarly to those obtained in Example 1.

In particular, the positive print obtained by the use of Sample 3-1 had good adhesiveness between adjacent layers and was excellent in water resistance.

While the invention has been described in detail and with reference to specific embodiments thereof, it will be apparent to one skilled in the art that various changes and modifications can be made therein without departing from the spirit and scope thereof.

What is claimed is:

1. A silver salt diffusion transfer photographic element comprising (1) a light-sensitive element including a light-sensitive silver halide emulsion layer containing silver iodide, and (2) an image-receiving element including a support and an image-receiving layer containing silver-depositing nuclei, with said image-receiving element having an iodide ion-capturing layer between said support and said image-receiving layer, said photographic element further comprising an alkali neutralizing layer and wherein said iodide ion-capturing layer is present between the support and the alkali neutralizing layer.

2. A silver salt diffusion transfer photographic element as in claim 1, wherein said iodide ion-capturing layer contains an anion exchange polymer.

3. A silver salt diffusion transfer photographic element as in claim 2, wherein said anion exchange polymer is represented by formula (I)

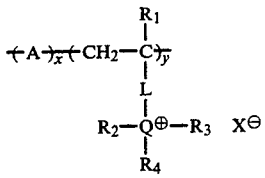

(I)

wherein A represents a repeating unit formed from an ethylenic unsaturated monomer unit; $R_1$ represents a hydrogen atom or a lower alkyl group having from 1 to about 6 carbon atoms; L represents a divalent group having from 1 to about 20 carbon atoms; $R_2$, $R_3$, and $R_4$ each represents an alkyl group having from 1 to about 20 carbon atoms or an aralkyl group having from 7 to about 20 carbon atoms, or two of $R_2$, $R_3$, and $R_4$ combine with each other to form a ring structure together with Q; Q represents N or P; $X^{\ominus}$ represents an anion other than iodide; x is from 0 to about 90 mol%; and y is from about 10 to 100 mol%.

4. A silver salt diffusion transfer photographic element as in claim 3, wherein A represents a repeating unit formed from at least one monomer selected from the group consisting of styrenes and methacrylates.

5. A silver salt diffusion transfer photographic element as in claim 3, wherein $R_1$ is a hydrogen atom or a methyl group.

6. A silver salt diffusion transfer photographic element as in claim 4, wherein $R_1$ is a hydrogen atom or a methyl group.

7. A silver salt diffusion transfer photographic element as in claim 3, wherein L has a structure selected from the group consisting of

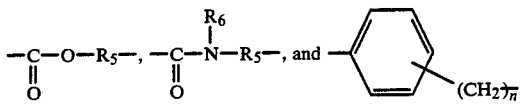

wherein $R_5$ represents an alkylene group, an arylene group, or an aralkylene group, $R_6$ represents a hydrogen atom or a substituent as represented by $R_2$, and n is an integer of 1 or 2.

8. A silver salt diffusion transfer photographic element as in claim 3, wherein Q represents N.

9. A silver salt diffusion transfer photographic element as in claim 3, wherein $X^-$ represents a chloride ion, alkylsulfate ion, arylsulfonate ion, or nitrate ion.

10. A silver salt diffusion transfer photographic element as in claim 3, wherein x is from 20 to 60 mol%, and y is from 40 to 80 mol%.

11. A silver salt diffusion transfer photographic element as in claim 3, wherein the anion exchange polymer is present in the iodide ion-capturing layer in the form of an aqueous polymer latex.

12. A silver salt diffusion transfer photographic element as in claim 1, wherein the coverage of an iodide ion-capturing agent in the iodide ion-capturing layer is from 0.5 to 4.0 g/m$^2$.

13. A silver salt diffusion transfer photographic element as in claim 2, wherein the anion exchange polymer is present in a range of from 0.5 to 4.0 g/m$^2$.

14. A silver salt diffusion transfer photographic element as in claim 3, wherein the anion exchange polymer is present in a range of from 0.5 to 4.0 g/m$^2$.

15. A silver salt diffusion transfer photographic element as in claim 1, wherein said photographic element is of an integral unit structure which has a light-sensitive layer and an image-receiving layer on the same support.

16. A silver salt diffusion transfer photographic element as in claim 3, wherein said anion exchange polymer is a copolymer comprising the repeating unit represented by formula (I) above and a monomer copolymerizable therewith having at least two ethylenic unsaturated moieties.

17. A silver salt diffusion transfer photographic element as in claim 16, wherein said copolymerizable monomer is selected from the group consisting of ethylene glycol dimethacrylate, diethylene glycol dimethacrylate, neopentyl glycol dimethacrylate, tetramethylene glycol dimethacrylate, pentaerythritol tetramethacrylate, trimethylolpropane trimethacrylate, ethylene glycol diacrylate, diethylene glycol diacrylate, neopentyl glycol diacrylate, tetramethylene glycol diacrylate, trimethylolpropane triacrylate, allylmethacrylate, allylacrylate, diallylphthalate, methylenebisacrylamide, methylenebismethacrylamide, trivinylcyclohexane, divinylbenzene, N,N-bis(vinylbenzyl)-N,N-dimethylammonium chloride, N,N-diethyl-N-(methacryloxyloxyethyl)-N-(vinylbenzyl)ammonium chloride, N,N,N',N'-tetraethyl-N',N'-bis(vinylbenzyl)-p-xylylenediammonium dichloride, N,N'-bis(vinylbenzyl)-triethylenediammonium dichloride, and N,N,N',N'-tetrabutyl-N,N'-bis(vinylbenzyl)ethylenediammonium dichloride.

18. A silver salt diffusion transfer photographic element as in claim 16, wherein said copolymerized monomer is selected from the group consisting of divinylbenzene and trivinylcyclohexane.

19. A silver salt diffusion transfer photographic element as in claim 16, wherein said anion exchange polymer is in the form of an aqueous polymer latex.

20. A silver salt diffusion transfer photographic element as in claim 16, wherein $R_1$ in formula (I) represents a hydrogen atom or a methyl group.

21. A silver salt diffusion transfer photographic element as in claim 19, wherein $R_1$ in formula (I) represents a hydrogen atom or a methyl group.

22. A silver salt diffusion transfer photographic element as in claim 16, wherein said anion exchange polymer contains the copolymerizable monomer in a proportion of 1 to 20 mol% based on the total monomer units.

23. A silver salt diffusion transfer photographic element as in claim 19, wherein said anion exchange polymer contains the copolymerizable monomer in a proportion of 1 to 20 mol% based on the total monomer units.

24. A silver salt diffusion transfer photographic element as in claim 22, wherein said anion exchange polymer contains the copolymerizable monomer in a proportion of 3 to 15 mol% based on the total monomer units.

25. A silver salt diffusion transfer photographic element as in claim 23, wherein said anion exchange polymer contains the copolymerizable monomer in a proportion of 3 to 15 mol% based on the total monomer units.

26. A silver salt diffusion transfer photographic element comprising (1) a light-sensitive element including a light-sensitive silver halide emulsion layer containing silver iodide, and (2) an image-receiving element including a support and an image-receiving layer containing silver-depositing nuclei, with said image-receiving element having an iodide ion-capturing layer between said support and said image-receiving layer, said photographic element further comprising an alkali neutralizing layer and a neutralization timing layer and wherein said iodide ion-capturing layer is present between the alkali neutralizing layer and the neutralization timing layer.

27. A silver salt diffusion transfer photographic element as in claim 26, wherein said iodide ion-capturing layer contains an anion exchange polymer.

28. A silver salt diffusion transfer photographic element as in claim 27, wherein said anion exchange polymer is represented by formula (I)

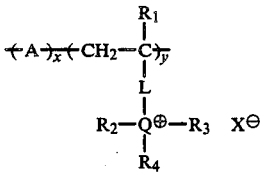

(I)

wherein A represents a repeating unit formed from an ethylenic unsaturated monomer unit; $R_1$ represents a hydrogen atom or a lower alkyl group having from 1 to about 6 carbon atoms; L represents a divalent group having from 1 to about 20 carbon atoms; $R_2$, $R_3$ and $R_4$ each represents alkyl group having from 1 to about 20 carbon atoms or an aralkyl group having from 7 to about 20 carbon atoms, or two of $R_2$, $R_3$ and $R_4$ combine with each other to form a ring structure together with Q; Q represents N or P; $X^{\ominus}$ represents an anion other than iodide; x is from 0 to about 90 mol%; and y is from about 10 to 100 mol%.

29. A silver salt diffusion transfer photographic element as in claim 28, wherein A represents a repeating unit from from at least one monomer selected from the group consisting of styrenes and methacrylates.

30. A silver salt diffusion transfer photographic element as in claim 28, wherein $R_1$ is a hydrogen atom or a methyl group.

31. A silver salt diffusion transfer photographic element as in claim 29, wherein $R_1$ is a hydrogen atom or a methyl group.

32. A silver salt diffusion transfer photographic element as in claim 28, wherein L has a structure selected from the group consisting of

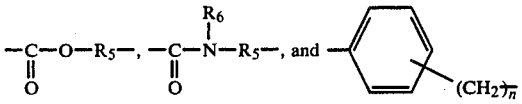

wherein $R_5$ represents an alkylene group, an arylene group, or an aralkylene group, $R_6$ represents a hydrogen atom or a substituent as represented by $R_2$, and n is an integer of 1 or 2.

33. A silver salt diffusion transfer photographic element as in claim 28, wherein Q represents N.

34. A silver salt diffusion transfer photographic element as in claim 28, wherein $X^-$ represents a chloride ion, alkylsulfate ion, arylsulfonate ion or nitrate ion.

35. A silver salt diffusion transfer photographic element as in claim 28, wherein x is from 20 to 60 mol%, and y is from 40 to 80 mol%.

36. A silver salt diffusion transfer photographic element as in claim 28, wherein the anion exchange polymer is present in the iodide ion-capturing layer in the form of an aqueous polymer latex.

37. A silver salt diffusion transfer photographic element as in claim 26, wherein the coverage of an iodide ion-capturing agent in the iodide ion-capturing layer is from 0.5 to 4.0 g/m$^2$.

38. A silver salt diffusion transfer photographic element as in claim 27, wherein the anion exchange polymer is present in a range of from 0.5 to 4.0 g/m$^2$.

39. A silver salt diffusion transfer photographic element as in claim 28, wherein the anion exchange polymer is present in a range of from 0.5 to 4.0 g/m$^2$.

40. A silver salt diffusion transfer photographic element as in claim 26, wherein said photographic element is of an integral unit structure which has a light-sensitive layer and an image-receiving layer on the same support.

41. A silver salt diffusion transfer photographic element as in claim 28, wherein said anion exchange polymer is a copolymer comprising the repeating unit represented by formula (I) above and a monomer copolymerizable therewith having at least two ethylenic unsaturated moieties.

42. A silver salt diffusion transfer photographic element as in claim 41, wherein said copolymerizable monomer is selected from the group consisting of ethylene glycol dimethacrylate, diethylene glycol dimethacrylate, neopentyl glycol dimethacrylate, tetramethylene glycol dimethacrylate, pentaerythritol tetramethacrylate, trimethylolpropane trimethacrylate, ethylene glycol diacrylate, diethylene glycol diacrylate, neopentyl glycol diacrylate, tetramethylene glycol diacrylate, trimethylolpropane triacrylate, allylmethacrylate, allylacrylate, diallylphthalate, methylenebisacrylamide, methylenebismethacrylamide, trivinylcyclohexane, divinylbenzene, N,N-bis(vinylbenzyl)-N,N-dimethylammonium chloride, N,N-diethyl-N-(methacryloyloxyethyl)-N-(vinylbenzyl)ammonium chloride, N,N,N',N'-tetraethyl-N',N'-bis(vinylbenzyl)-p-xylylenediammonium dichloride, N,N'-bis(vinylbenzyl)-triethylenediammonium dichloride, and N,N,N'N'-tetrabutyl-N,N'-bis(vinylbenzyl)ethylenediammonium dichloride.

43. A silver salt diffusion transfer photographic element as in claim 41, wherein said copolymerized monomer is selected from the group consisting of divinylbenzene and trivinylcyclohexane.

44. A silver salt diffusion transfer photographic element as in claim 41, wherein said anion exchange polymer is in the form of an aqueous polymer latex.

45. A silver salt diffusion transfer photographic element as in claim 41, wherein $R_1$ in formula (I) represents a hydrogen atom or a methyl group.

46. A silver salt diffusion transfer photographic element as in claim 44, wherein $R_1$ in formula (I) represents a hydrogen atom or a methyl group.

47. A silver salt diffusion transfer photographic element as in claim 41, wherein said anion exchange polymer contains the copolymerizable monomer in a proportion of 1 to 20 mol% based on the total monomer units.

48. A silver salt diffusion transfer photographic element as in claim 44, wherein said anion exchange polymer contains the copolymerizable monomer in a proportion of 1 to 20 mol% based on the total monomer units.

49. A silver salt diffusion transfer photographic element as in claim 47, wherein said anion exchange polymer contains the copolymerizable monomer in a proportion of 3 to 15 mol% based on the total monomer units.

50. A silver salt diffusion transfer photographic element as in claim 48, wherein said anion exchange polymer contains the copolymerizable monomer in a proportion of 3 to 15 mol% based on the total monomer units.

* * * * *